US005309862A

United States Patent [19]

Lang

[11] Patent Number: 5,309,862

[45] Date of Patent: May 10, 1994

[54] FLAG HOLDER FOR HIGHWAY SIGN

[76] Inventor: Paul A. Lang, 555 14th St., Newport, Minn. 55055

[21] Appl. No.: 107,533

[22] Filed: Aug. 17, 1993

[51] Int. Cl.[5] ..... G09F 17/00

[52] U.S. Cl. ..... 116/173; 116/63 R

[58] Field of Search ..... 116/63 R, 63 P, 173; 40/607, 610, 612; 248/521, 528, 538, 529

[56] References Cited

U.S. PATENT DOCUMENTS

| | | | |
|---|---|---|---|
| 4,288,053 | 9/1981 | Sarkisian | 40/607 X |
| 4,619,220 | 10/1986 | Seely et al. | 116/63 P |
| 4,980,984 | 1/1991 | Kulp et al. | 40/610 |
| 5,152,091 | 10/1992 | Leach | 40/603 |
| 5,197,408 | 3/1993 | Stoudt | 116/173 |

FOREIGN PATENT DOCUMENTS

| | | | |
|---|---|---|---|
| 0544020 | 9/1922 | France | 248/514 |
| 0552331 | 4/1923 | France | 248/514 |
| 0001919 | of 1884 | United Kingdom | 248/514 |
| 0012633 | of 1892 | United Kingdom | 248/514 |

*Primary Examiner*—Thomas B. Will
*Assistant Examiner*—W. Morris Worth
*Attorney, Agent, or Firm*—Burd, Bartz & Gutenkauf

[57] ABSTRACT

A flag holder for attachment to a standard highway sign, for holding a pair of symmetrically arrayed warning flags at the top of the sign, and for permitting the flags to be folded downwardly for transport and storage. When used on roll-up highway signs the flags may be rolled up along with the roll-up sign. The holder includes an elongated rigid holder body which is adapted for attachment adjacent the top of a standard rigid or roll-up highway warning sign. Attachment is by means of bolts in the case of a rigid sign, or at least one clamp attached to the body for fixedly securing the body to the strut or brace of a roll-up sign. A pair of elongated flag staffs are pivotally attached at one end to the holder body and each has a flexible warning flag at the other end. To hold the flags in open operable position a pair of elongated spring clips extend between a point on the holder body spaced from the pivotal attachment of the flat flag staffs to the body and a point on the flag staffs spaced from their pivotal attachment to the holder body. The spring clips have a pivotal connection at one end and a separable male-female stud-aperture connection at the other end. The spring clips may be pivotally connected to the holder body and make a separable male-female stud-aperture connection to the flag staff, or the spring clip may be pivotally connected to the flag staff and make a separable connection with the holder body.

18 Claims, 4 Drawing Sheets

FLAG HOLDER FOR HIGHWAY SIGN

BACKGROUND OF THE INVENTION

1. FIELD OF THE INVENTION

This invention relates to a flag holder used on portable highway or road signs to increase visibility of such signs to approaching traffic. It is common practice to affix one or more warning flags which extend above the top of the highway sign. This invention is directed to a flag holder in which pivotally mounted symmetrically arranged flags may be easily snapped into operating position from their folded storage position, and just as easily refolded after use.

2. THE PRIOR ART

Sarkisian U.S. Pat. No. 4,288,053 and Kulp et al U.S. Pat. No. 4,980,984 are exemplary of patents directed to highway signs having flags mounted to extend above the top of the signs. Applicant's co-pending application Ser. No. 954,311, filed Sep. 30, 1992, also discloses a portable highway sign having warning flags mounted at the top thereof.

SUMMARY OF THE INVENTION

Broadly stated the invention is directed to a flag holder for attachment to a standard highway warning sign, for holding a pair of symmetrically arrayed warning flags at the top of the sign, and for permitting the flags to be folded downwardly for transport and storage. When used on roll-up highway signs the flags may be rolled up along with the roll-up sign. The holder includes an elongated rigid holder body which is adapted for attachment adjacent the top of a standard rigid o roll-up highway warning sign. Attachment is by means of bolts in the case of a rigid sign, or at least one clamp attached to the body for fixedly securing the body to the strut or brace of a roll-up sign. A pair of elongated flag staffs are pivotally attached at one end to the holder body and each has a flexible warning flag at the other end. To hold the flag holder in open operable position a pair of elongated spring clips extend between a point on the holder body spaced from the pivotal attachment of the flat flag staffs to the body and a point on the flag staffs spaced from their pivotal attachment to the holder body. The spring clips have a pivotal connection at one end and a separable male-female stud-aperture connection at the other end. The spring clips may be pivotally connected to the holder body and make a separable male-female stud-aperture connection to the flag staff, or the spring clip may be pivotally connected to the flag staff and make a separable connection with the holder body.

BRIEF DESCRIPTION OF THE DRAWINGS

The invention is illustrated by the accompanying drawings in which corresponding parts are identified by the same numerals and in which.

DETAILED DESCRIPTION OF THE PREFERRED EMBODIMENT

Figure 1:
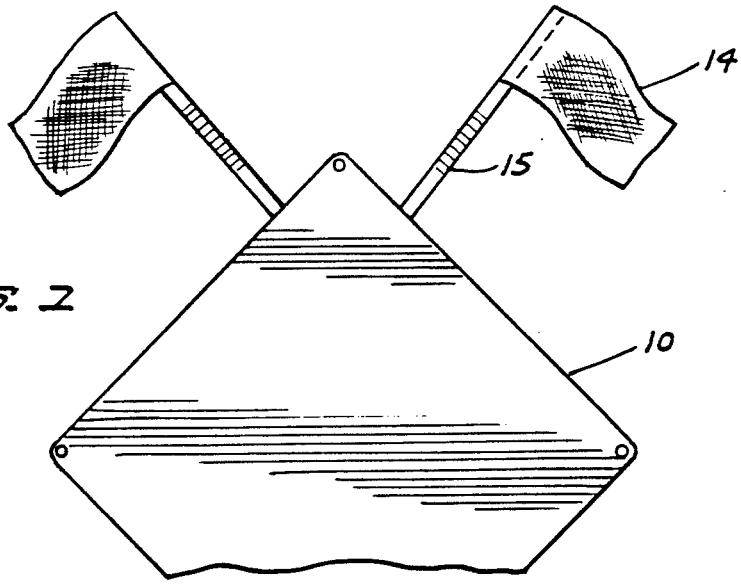
FIG. 1 is a fragmentary front elevational view of a standard roll-up highway sign with warning flags.
Figure 2:
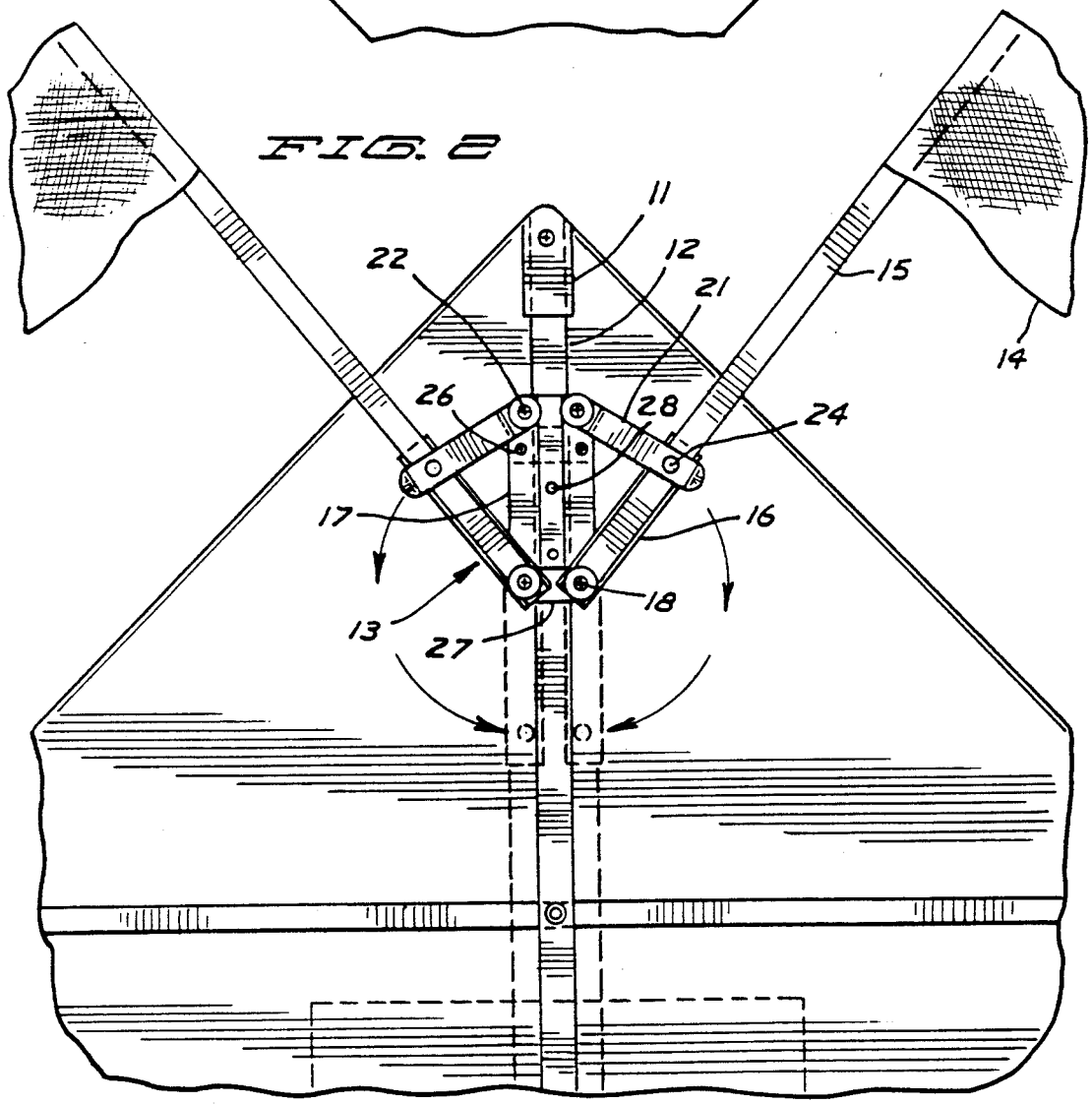
FIG. 2 is a fragmentary rear elevation on an enlarged scale of a similar sign showing the flag holder according to the present invention.

Referring now to the drawings, and particularly to FIGS. 1 and 2 there is shown a standard roll-up sign 10 formed of fabric and bearing an informational, regulatory or warning message. The warning sign is rectangular in shape and generally oriented diagonally in the familiar diamond shape. As is standard practice, the reverse side of the roll-up sign has a pocket 11 or other fastening means at each corner to engage the ends of a pair of semi-rigid struts or braces 12, usually formed of fiberglass. Although the invention is illustrated with reference to a standard roll-up highway warning sign, it is equally applicable to use with roll-up informational and regulatory signs and rigid signs, as pointed out hereinafter.

A flag holder, indicated generally at 13, is secured adjacent to the top end of sign strut or brace 12 to support a pair of warning flags 14, each supported at one end of a flag staff 15. The flag staff usually is semi-rigid, formed of fiberglass, wood, metal, etc., comparable to strut or brace 12. The opposite end of flag staff 15 is provided with a flat nearly rigid channel member 16 which provides a nearly rigid reinforced end for the flag staff and limits the degree of flex caused by the wind for it and for staff 15. The flag staff is pivotally attached to one end of flag holder body 17 as by means of bolts 18 or equivalent fastening means. Holder body 17 is elongated with a central shallow longitudinal channel 19 and parallel longitudinal flanges 20 extending outwardly from opposite edges of the channel. As is apparent, the opposite sides of the flag holder are mirror images about the longitudinal axis of the holder body.

Figure 6:
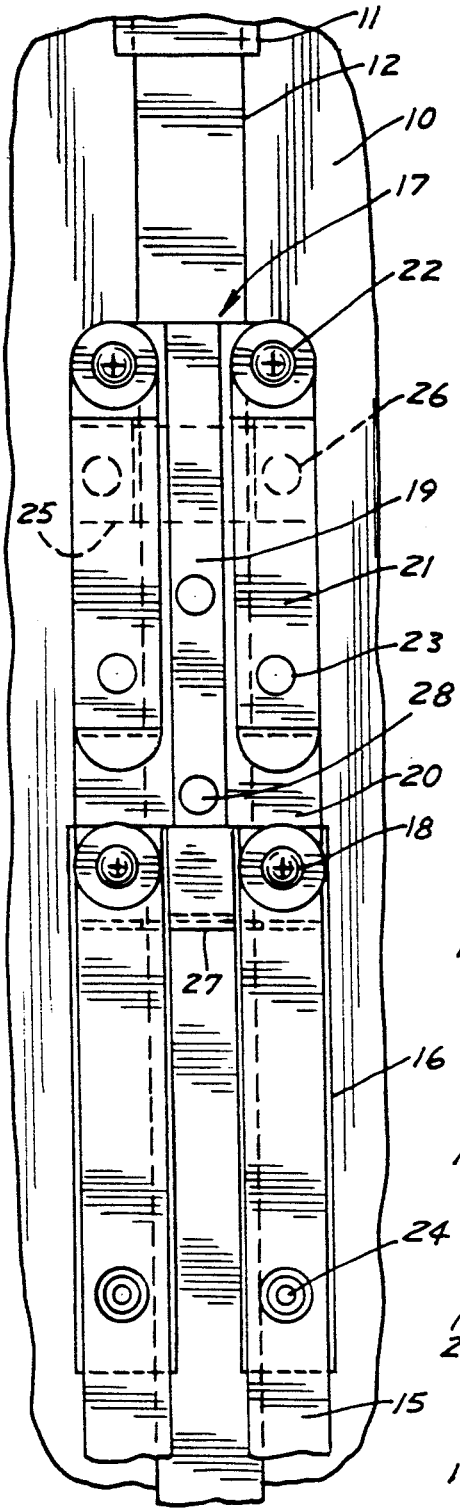
FIG. 6 is a fragmentary elevational view showing the flags in folded configuration.
Figure 7:
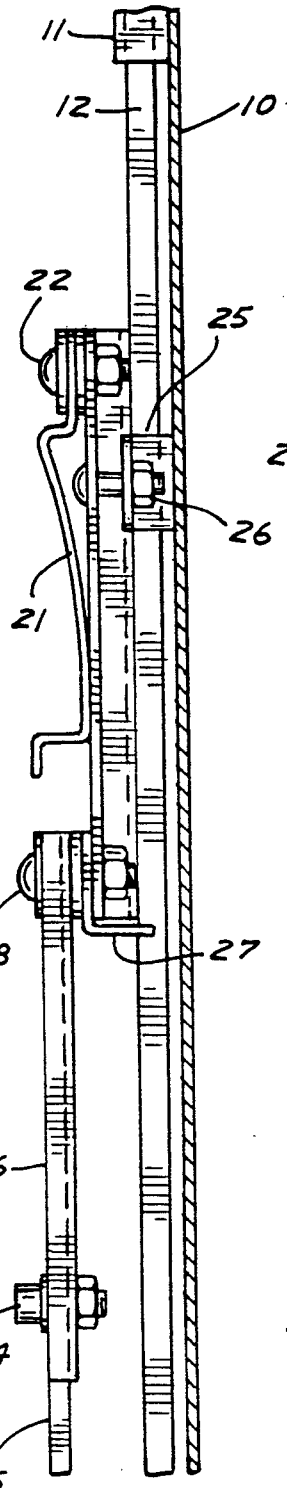
FIG. 7 is a fragmentary right side elevation of the folded flag holder shown in FIG. 6.

A pair of spring clips 21 are pivotally connected, as by bolts 22 or equivalent fastening means, to the flanges 20 at the opposite end of the holder body 17. Spring clip 21 has an aperture 23 spaced inwardly from its opposite end and adapted, when the flags are in deployed configuration as shown in FIGS. 1 and 2, to engage a stud 24 which is the head of a bolt spaced from pivot bolt 18 and securing flag staff 15 in channel 16. The spring force exerted by clip 21 onto the staff or holder body is sufficient to maintain engagement between the clip and stud to securely hold the flag staffs in their deployed configuration while the staff 15 flexes in a preferred plane under changing wind loading. At the same time, the spring clip is easily released by lifting it from the stud to permit the flag staffs to be rotated to their folded position as shown in FIGS. 6 and 7. The spring force of clip 2 maintains the connection with the flag staff even in high and gusty winds. The spring clip material is strong enough to hold the flat staff at the deployed position and in its plane. If the wind velocity is sufficient to bend strut or brace 12 or flag staff 15, the flexibility of the clip permits the clip to bend with the other sign components and maintain the connection.

Figure 4:
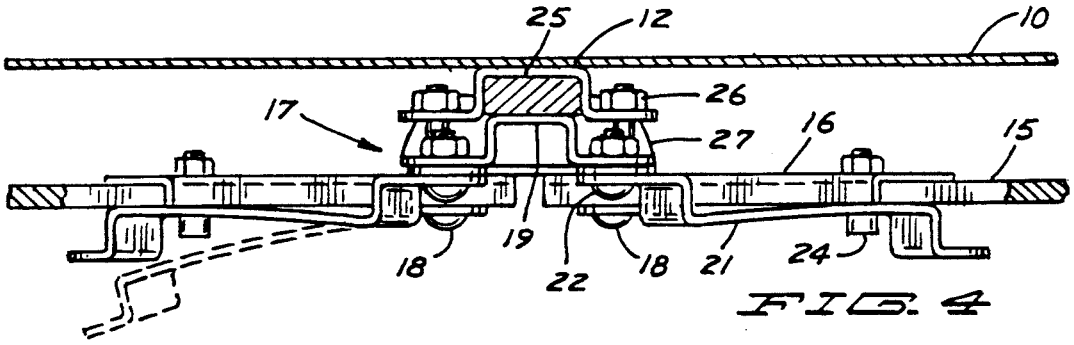
FIG. 4 is a section on the line 4—4 of FIG. 3 and in the direction of the arrows.
Figure 5:
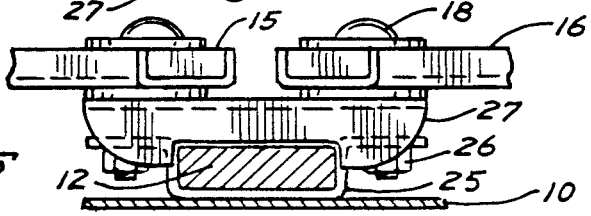
FIG. 5 is a sectional view on the line 5—5 of FIG. 3 and in the direction of the arrows.

As best seen in FIGS. 4 and 5, the flag holder body 17 is secured to the brace or strut 12 of a roll-up sign by means of a clamp or bracket 25 which extends around the brace or strut and has outwardly extending flanges on opposite sides which are fastened to the body 17 by bolts 26. For maximum rigidity two such clamps, longitudinally spaced apart relative to the body 17, may be used. Alternatively, a toothed bracket 27, as shown, may be attached to the body 17, or continuously formed as part of the body, spaced from the clamp 25 and having spaced apart teeth which engage the side edges of the brace or strut 12 to increase rotational stability of the body 17 on strut 12. A toothed bracket 27 may be provided at both the top and bottom of the body. For attachment of the body 17 to a rigid sign, a plurality of bolt holes 28 are provided through which fastening bolts may be passed for connection to the corresponding brace or strut structure of the rigid sign through similar holes therein.

Figure 8:
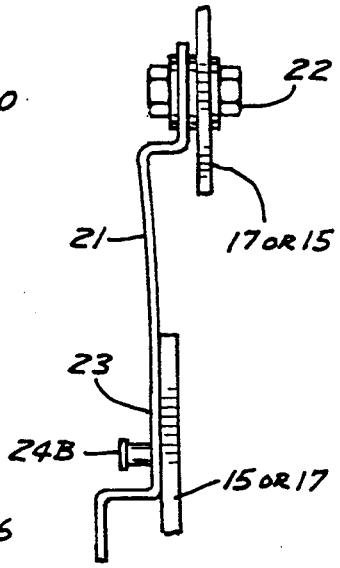
FIGS. 8 and 9 are schematic representations of the alternative variations of male-female stud-aperture connections between the flag holder and flag staff.
Figure 9:
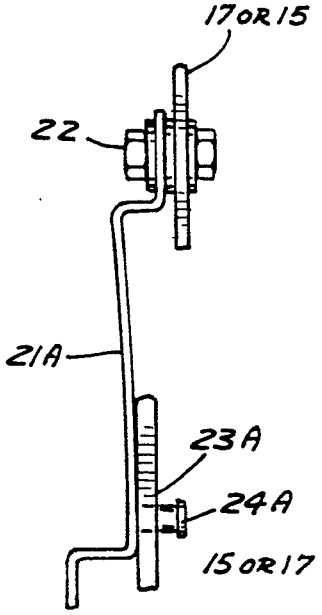
Figure 3:
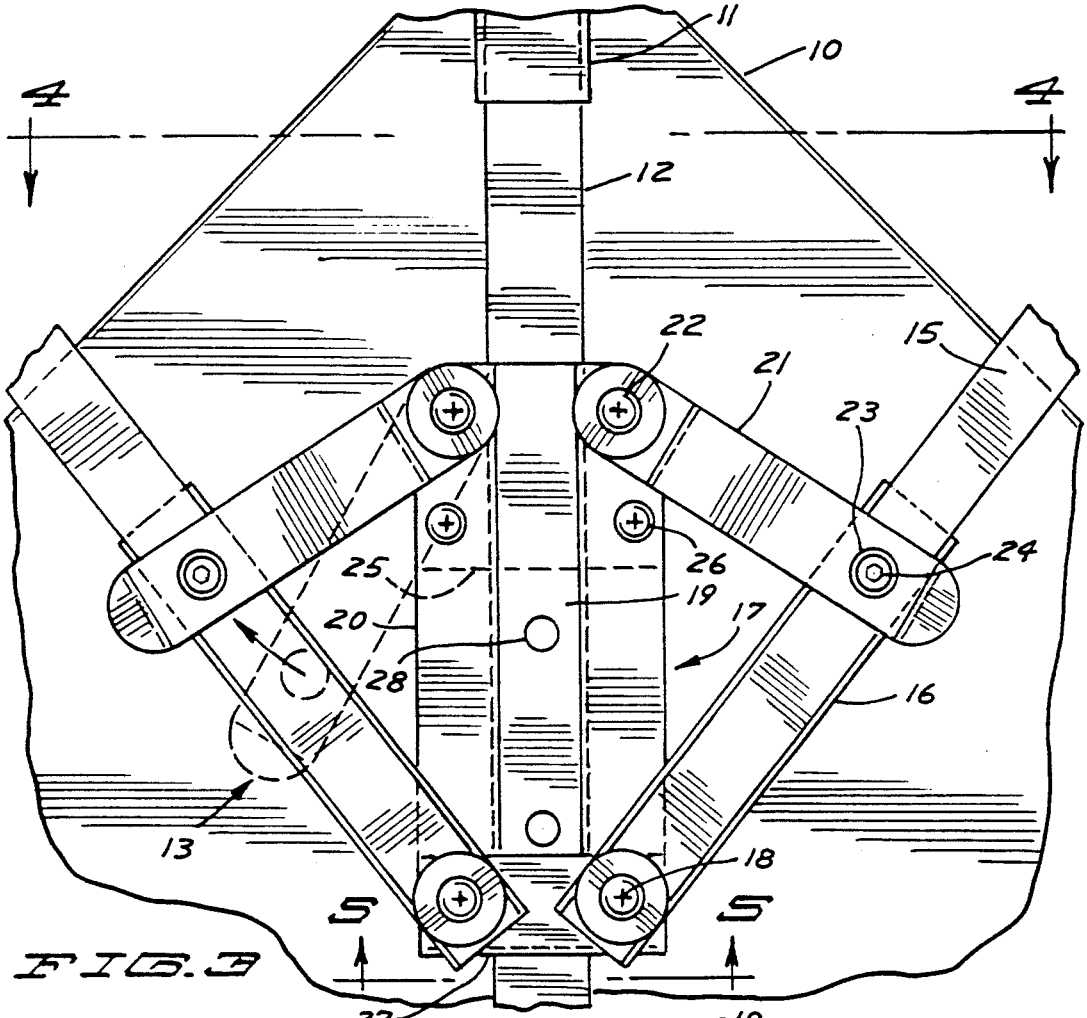
FIG. 3 is a further enlarged fragmentary elevational view of the flag holder.

As shown in FIGS. 2, 3 and 4, the spring clips 21 are pivotally attached to the body 17. The stud 24 which is engaged by hole 23 in the clip is on the flag staff 15. As shown schematically in FIGS. 8 and 9, three additional forms of male-female stud-aperture connections may be made between the spring clip and flag staff. With the spring clip pivotally connected to the body 17 the stud 24A may be attached adjacent the end of the clip 21A engageable with a hole 23A in the flag staff. Alternatively, a clip 21A fitted with a stud 24A may be pivotally connected to the flag staff and engage a hole 23A in the holder body. The spring clip 21 having a hole 23 therein may be pivotally connected to the flag staff 15 and engageable with a stud 24B on body 17. The spring clip 21A having a stud 24A at its end may be pivotally connected to the flag staff 15 and engageable with a hole 23B in the holder body.

When the spring clips 21 and 21A are pivotally connected to the holder body 17, when the flags are in their folded position, the spring clips ar rotated to lie in alignment with the holder body, whether the clip carries a hole or a stud. Similarly, when the spring clips are pivotally connected to the flag staffs, when the flags are in their folded position, the clips are rotated to lie in alignment with the flag staffs.

Although spring clips 21 are shown as independently pivotally connected to body 17 in FIGS. 2 through 6, it is possible, although less desirable, for them to share a common pivotal connection. Similarly, although the ends of flag staffs 15 are shown as independently pivotally connected to the body 17, they may likewise be connected by a common pivotal connection, although this is less desirable than separate connections.

Figure 10:
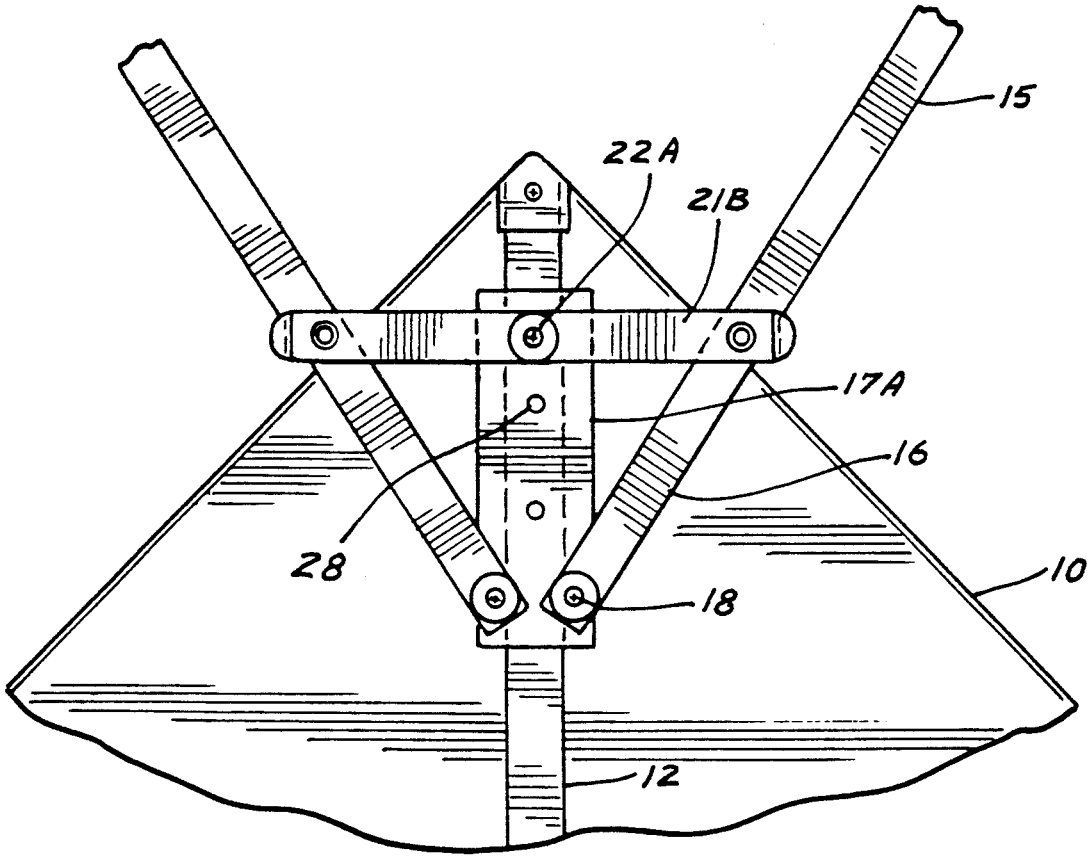
FIG. 10 is a fragmentary elevational view showing an alternative form of spring clip.

Referring to FIG. 10 there is shown an alternative form of construction in which the pair of spring clips 21B are integral, formed from a single strip of spring steel, and sharing a common pivotal connection 22A with the flag holder body 17A. These unitary spring clips function essentially in the manner already described. They may have holes adjacent to their free ends to engage studs on the flag staffs or they may have studs engageable with holes in the flag staffs. When not in use the one piece spring clips fold to lie parallel to the vertical brace or strut.

It is apparent that many modifications and variations of this invention as hereinbefore set forth may be made without departing from the spirit and scope thereof. The specific embodiments described are given by way of example only and the invention is limited only by the terms of the appended claims.

I claim:

1. A flag holder for attachment to a standard temporary highway warning sign, for holding a pair of symmetrically arrayed warning flags at a top of the sign, said holder comprising:

a) an elongated rigid holder body adapted for attachment in vertical alignment adjacent to the top of a standard highway warning sign, b) means for fixedly securing the holder body to the sign, c) a pair of elongated flag staffs pivotally attached at one end to said body and having a warning flag at the other end, d) a pair of elongated spring clips extending, when the flag holder is in open operable, position, between a point on said body spaced from points of pivotal attachment of the flag staffs to the body and a point on said flag staffs spaced from the points of pivotal attachment of the flag staffs to the body, e) a pivotal connection at one end of each of said spring clips between said clips and one of said body and said flag staffs and f) a separable male-female stud-aperture connection at the other end of each of said spring clips between said clips and one of said body and said flag staffs.

2. A flag holder according to claim 1 wherein said pivotal connection at one end of said spring clips is between said clip and said body and said stud-aperture connection at the other end of the spring clip is between said clip and flag staff.

3. A flag holder according to claim 2 wherein the stud portion of said stud-aperture connection is on said flag staff and the aperture portion is in said clip.

4. A flag holder according to claim 2 wherein the stud portion of said stud-aperture connection is on said clip and the aperture portion is in said flag staff.

5. A flag holder according to claim 1 wherein said pivotal connection at one end of said spring clips is between said clip and said flag staff and said stud-aperture connection at the other end of the spring clip is between said clip and body.

6. A flag holder according to claim 5 wherein the stud portion of said stud-aperture connection is on said body and the aperture portion is in said clip.

7. A flag holder according to claim 5 wherein the stud portion of said stud-aperture connection is on said clip and the aperture portion is in said body.

8. A flag holder according to claim 1 wherein said means for fixedly securing the holder body to the sign comprises at least one clamp attached to the body and adapted to extend around and engage a strut or brace of a standard roll-up highway sign.

9. A flag holder according to claim 1 wherein said means for fixedly securing the holder body to the sign comprises at least one bolt hole for receiving a bolt to extend through and engage a standard rigid highway sign.

10. A flag holder according to claim 2 wherein said pair of spring clips is integral, pivotally connected to said body midway between said clips.

11. A flag holder for attachment to a vertical strut or brace of a standard roll-up highway sign, for holding a pair of symmetrically arrayed warning flags at a top of the sign, said holder comprising:

a) an elongated rigid holder body adapted for attachment in longitudinal alignment to the vertical strut or brace of a standard roll-up highway warning sign, b) at least one clamp attached to said body for fixedly securing the body to said strut or brace, c) a pair of elongated flag staffs pivotally attached at one end to said body and having a warning flag at the other end, d) a pair of elongated spring clips extending, when the flag holder is in open operable position, between a point on said body spaced from points of pivotal attachment of the flag staffs to the body and a point on said flag staffs spaced from the points of pivotal attachment of the flag staffs to the body, e) a pivotal connection at one end of each of said spring clips between said clips and one of said body and said flag staffs and f) a separable male-female stud-aperture connection at the other end of each of said spring clips between said clips and one of said body and said flag staffs.

12. A flag holder according to claim 11 wherein said pivotal connection at one end of said spring clips is between said clip and said body and said stud-aperture connection at the other end of the spring clip is between said clip and flag staff.

13. A flag holder according to claim 12 wherein the stud portion of said stud-aperture connection is on said flag staff and the aperture portion is in said clip.

14. A flag holder according to claim 12 wherein the stud portion of said stud-aperture connection is on said clip and the aperture portion is in said flag staff.

15. A flag holder according to claim 11 wherein said pivotal connection at one end of said spring clips is between said clip and said flag staff and said stud-aperture connection at the other end of the spring clip is between said clip and body.

16. A flag holder according to claim 15 wherein the stud portion of said stud-aperture connection is on said body and the aperture portion is in said clip.

17. A flag holder according to claim 15 wherein the stud portion of said stud-aperture connection is on said clip and the aperture portion is in said body.

18. A flag holder according to claim 12 wherein said pair of spring clips is integral, pivotally connected to said body midway between said clips.

* * * * *

UNITED STATES PATENT AND TRADEMARK OFFICE

CERTIFICATE OF CORRECTION

PATENT NO. : 5,309,862

DATED : May 10, 1994

INVENTOR(S) : Paul A. Lang

It is certified that error appears in the above-identified patent and that said Letters Patent is hereby corrected as shown below:

Column 1, line 35 "o" should be ---or---;

Column 2, line 62 "2" should be ---21---;

Column 3, line 40 "ar" should be ---are---.

Signed and Sealed this

Sixteenth Day of August, 1994

*Attest:*

*Attesting Officer*

Bruce Lehman

BRUCE LEHMAN

*Commissioner of Patents and Trademarks*